United States Patent [19]

Brown

[11] Patent Number: 4,597,977

[45] Date of Patent: Jul. 1, 1986

[54] METHOD AND APPARATUS FOR SEPARATING HULLS AND DEBRIS FROM PLANT PRODUCTS

[76] Inventor: Ben S. Brown, Rte. 1, Baldwin, Ga. 30511

[21] Appl. No.: 742,551

[22] Filed: Jun. 7, 1985

[51] Int. Cl.[4] ..... B02B 3/08

[52] U.S. Cl. ..... 426/482; 99/519; 99/528; 99/574; 99/606; 130/30 H

[58] Field of Search ..... 426/482, 483; 99/519, 99/528, 574, 580, 605, 606; 130/30 H

[56] References Cited

U.S. PATENT DOCUMENTS 4,066,087 1/1978 Rodgers ..... 99/605

4,137,924 2/1979 White ..... 130/30 H

*Primary Examiner*—George Yeung

*Attorney, Agent, or Firm*—Patrick F. Henry

[57] ABSTRACT

A machine frame has a foraminous, inclined screen drum mounted for rotation thereon with an opening in one end which receives the peas for engagement by flat paddles attached in spaced relation to a horizontal, internal paddle shaft supported for rotation within the drum. A separating member supported on and rotating with the drum is spaced from the inside of the drum. The peas (kernels) fall through a closed housing to a shaker at the bottom and are collected in a pan. The hulls and trash are directed through the drum past the separating member and out of an opening at one end and into a trash bag. A blower on one end of the machine blows the trash through the housing. A drive means drives the drum and the paddles in opposite directions and also operates an eccentric to reciprocate the shaker.

18 Claims, 4 Drawing Figures

METHOD AND APPARATUS FOR SEPARATING HULLS AND DEBRIS FROM PLANT PRODUCTS

This invention relates to machines and apparatus for separating hulls and stems and the like from the internal beans or peas and to collecting the hulls and trash separately from the peas, beans and the like. The separation is obtained by rotating the vegetables such as peas or beans inside a screen drum in which there are members such as striking paddles which strike the vegetables.

Machines and apparatus for shelling or hulling vegetables, such as peas, beans or peanuts, are well known but all such known prior machines and apparatus have certain disadvantages with respect to separating the hulls and trash from the kernels of the peas and beans and require periodic internal cleaning sometimes every few minutes of operation. Some prior art machines are loaded by opening a section of the drum and then closing same for operation without continuous feed and input of the beans or peas during movement and without removal of the hulls or trash during processing and separation which means that more trash is deposited with the kernels. Thus, the use of striking members within a foraminous drum and the separation and dropping of the kernels from the hulls is well known in the art but the present method and machine is different.

The apparatus embodying the present invention receives whole beans or peas continuously or intermittently fed into one end of an inclined, foraminous, moving drum and then separates the kernels by rotating flat striking paddles and transverse baffle so that the separated kernels pass through the holes in the drum to a hopper-like housing through an optional shaker into a removable container while optionally at the same time the drier trash and debris that is mixed with kernels is blown through the top of the housing longitudinally away from the dropping kernels by means of an air producing means such as a blower and exits from the other end of the drum through an opening in the foraminous surface and the end of the drum.

Accordingly, there is the inclined, rotating cylindrical drum covered with a foraminous material such as a wire mesh of a certain size opeing, a drive means for driving the drum in a clockwise direction and for driving the striking paddles in a counter-clockwise direction within the drum, there being a baffle transversely of the drum and a space between the ends of the paddle and the inside of the drum, so that the hulls and trash or the like being processed are driven from one end of the drum to the other end of the drum while the kernels and some trash drop into a housing, an opening in the surface of the drum at the end for the hulls and trash to exit, a bottom housing, an opening in the end of the housing for the blown, drier trash to exit, an optional collection bag located at the end of the drum to receive and collect the hulls and debris, an optional shaker means located beneath the drum and beneath the bottom housing which directs the kernels to a foraminous shaker for separation of the kernels from any small trash that may remain, and a movable cover on the top of the drum. The drum may be provided with at least one removable, arcuate screen segment which provides access to the interior.

A primary object of the present invention is to improve the separation of the hulls and trash from the kernels in the processing and separation in the type of machine which uses a rotary drum and some sort of internal beaters or paddles counter-rotating with respect to the rotation of the drum.

Another object of the present invention is to provide a continuous feeding of the moving drum whereby the whole beans or peas may be fed contacted by striking members and moved through the inclined drum to discharge the separated kernels at the bottom through the foraminous surface of the drum while moving the hulls and trash by the striking members to the opposite end of the drum for removal. Accordingly, there is an advantage in the way the striking members such as paddles are located and driven within the inclined drum, spaced from the inner surface of the inclined drum, and the further separation of kernels and trash assisted by air beneath the drum while the drum is rotating. Among other things, this makes it possible to use a drive means which drives the drum and striking paddles in opposite directions as well as driving an optional shaker for the removal and separation of the kernels from remaining trash.

There is an advantage in the drive arrangement of the present machine whereby one motor drives the drum and the striking members at the proper speed and provides a power take-off for optional use of the shaker.

Other and further objects and advantages of this invention will appear upon reading the following description of the preferred embodiment taken in conjunction with the accompanying drawings, wherein.

DESCRIPTION OF A PREFERRED EMBODIMENT

As used sometimes in this description, the word product refers to the hulled item such as a bean, pea or peanut which has an internal kernel also known as beans, peas or peanuts or a shell product such as a 'peanut which is a kernel usually referred to as a peanut, whether shelled or unshelled, realizing that the purpose of the machine is to receive such product and to separate the kernel such as the pea, bean or peanut from the hull or shell and any accompanying trash such as stems, leaves and dirt and so forth.

Figure 1:
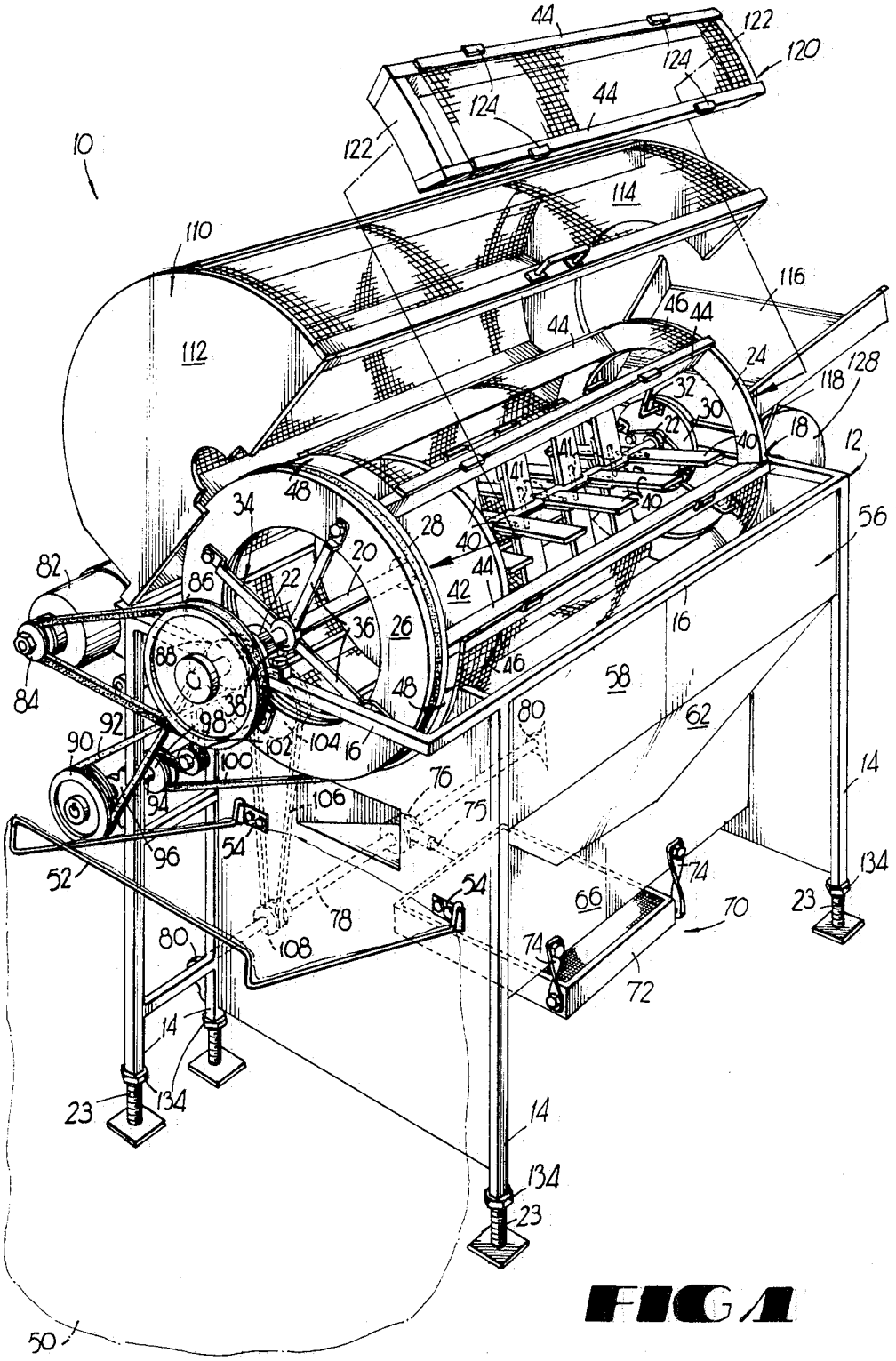
FIG. 1 is a perspective view of the present apparatus with the top open and a drum segment removed as when cleaning out the drum or making repairs or adjustment.
Figure 2:
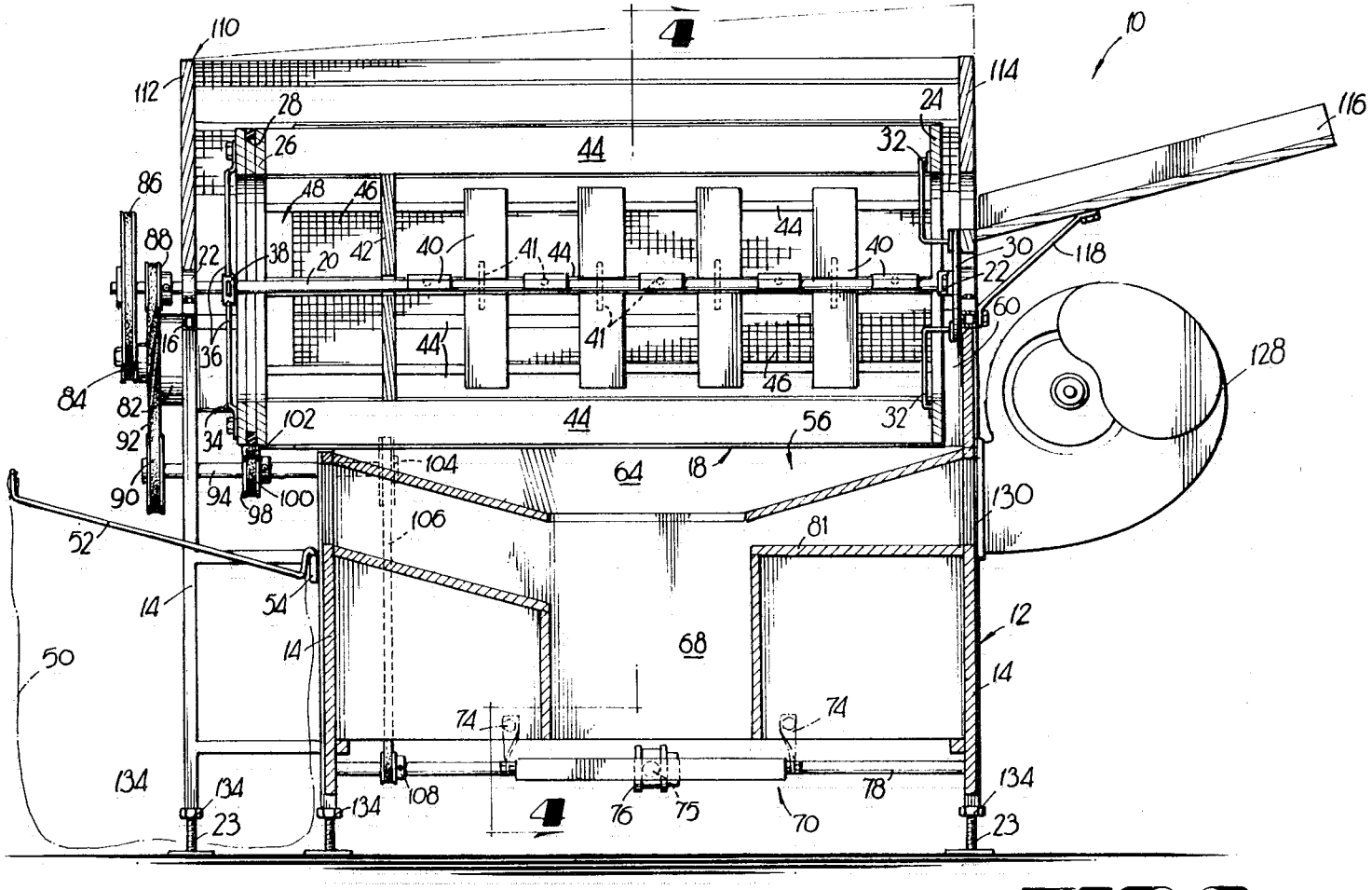
FIG. 2 is a sectional view taken substantially vertically through the apparatus shown in FIG. 1.
Figure 4:
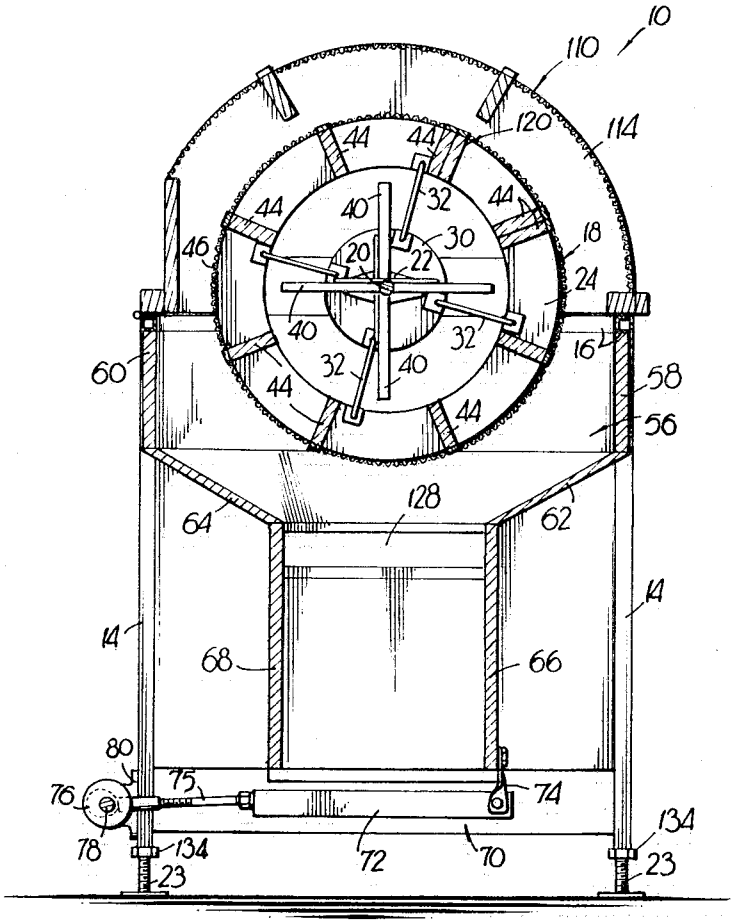
FIG. 4 is a cross-sectional view taken substantially along lines 4—4 in FIG. 2.
Figure 3:
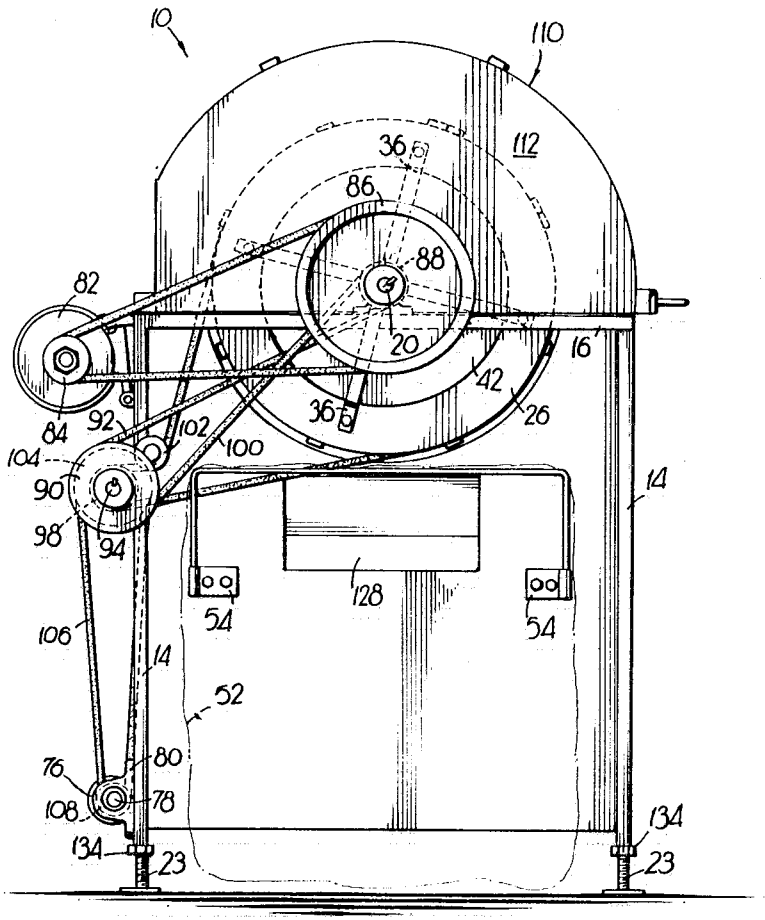
FIG. 3 is an end elevation view of one end of the apparatus shown in FIG. 1.

The entire apparatus 10 in FIG. 1 comprises a box-like frame 12 made up of vertical legs 14, which are adjustable on the input end, and horizontal frame members 16 defining a rectangular space in which is mounted an elongate drum 18 supported on opposing frame member 16 on a shaft 20 mounted in journal pillow-blocks 22 attached to the frame member 16. Normally in operation the machine 10 is inclined by raising the input end (from full lines to dotted lines in FIG. 2) which is easily done by rotating feet 23.

Drum 18 may be constructed from wood, such as plywood and lumber, or metal and comprises a circular open end member 24, in the form of an open disc, and at the opposite end of the drum an open end member 26 which is also an open disc constructed as a large pulley comprising a groove 28. There is a small disc plate 30 at the input end adjacent end member 24 connected by bent rod members 32 at several locations to the end member 24 so as to properly support and brace that end of the drum on the shaft 20. End member 26 is attached to shaft 20 by means of a bracket assembly 34 comprising four arms 36 connected to a center hub 38 which is mounted on shaft 20 for supporting that end of the drum 18.

Internally of drum 18 on shaft 20 are the plurality of striking members 40 being in the form of flat paddles which are attached by break-away, shear pins 41 at each of one respective end thereof to the shaft 20 at spaced locations longitudinally thereof as well as radially therearound so that the striking members 40 are spaced around the periphery of shaft 20 in the manner shown in FIG. 1 and other Figures of the drawings. There There is also a circular baffle or large disc plate 42 supported internally of the drum with a hole in the center thereof through which passes and in which rotates shaft 20. The end members 24, 26 of drum 18 are attached together rigidly to form the rigid rotating drum by means of longitudinal structural members 44 attached at each of the respective ends thereof at a respective location on the end member 24, 26 and extending down into the drum for a distance from the ends of each of the striking members 40. The disc plate 42 has the periphery thereof attached to the bottom edge of the longitudinal members 44 and is spaced from the inside of the drum 18 to provide a baffle which assists in separating the heavier kernels from hulls and trash which is delivered past the peripheral edge of baffle disc plate 42. The surface of drum 18 is covered by a screen wire mesh 46 that is a foraminous material covering the entire surface of the drum 18 except for a space 48 defined between the end of the screen 46 and the end member 26 through which hulls, trash and debris will exit at that end of the machine and may be collected in a removable trash bag 50 such as a plastic bag having the open mouth thereof fitted around a wire frame 52 which is removably supported on brackets 54. Typically, the drum 18 would have 3" members 44, also sometimes called slats, and a space of about 1½ inches between the end of the striking members 40 and the member 44. As mentioned previously, there is also a space between the members 44 and the peripheral edge of the disc plate 42 so that trash will be conveyed and blown through to the end opening 48 and the open end of end member 26.

The kernels are directed through the bottom portion of the drum 18 through the screen 46 as the drum 18 rotates and into a housing 56 comprising front member 58 and rear member 60, inclined front member 62 and rear member 64 and front bottom member 66, and rear bottom member 68 which provide a rectangular bottom opening which is partly closed to create a kernel opening over a bottom shaker which comprises a shaker frame 72 which is supported on brackets 74 mounted on the front bottom member 66 and supported by means of shaker arm 75 attached to a shaker cam member 76 which is an eccentric collar that is mounted on a longitudinal shaft 78 supported on bearing blocks 80 on opposite legs 14. Members 58, 60, 62, 64 and 66 form a longitudinal tunnel 81 leading from the input end to the output end of machine 10. Tunnel 81 is larger at the input, blower end than at the output end. Tunnel 81 is reduced by a baffle 81' at the input end so as to direct air to the exit opening 48.

Drive Means

An electric motor 82 mounted on frame 12 has an output pulley 84 which by means of a drive belt 84 drives a larger pulley 86 which is attached on shaft 20 on which there is, next to pulley 86, a smaller pulley 88 which drives a larger pulley 90 by means of a belt 92 which has been twisted so as to reverse the direction. Pulley 90 is mounted on a pulley shaft 94 supported in bearings 96 on the legs 14 and there is also a drum drive pulley 98 on shaft 94 which drives the large drum end member 26 by means of a drive belt 100 passing across an idler pulley 102. Another drive pulley 104 on shaft 94 drives through a belt 106, a pulley 108 attached to the shaft 78 for driving the shaker cam member 76 which reciprocates and shakes the shaker frame 72 by translating the rotary motion through the cam 76 to linear reciprocating motion of the arm 75. Thus, the kernels which are directed through the housing 56 are further separated from any smaller trash and debris prior to a collection in a removable collecting box (not shown) beneath shaker 70.

A top closure 110 for the drum 18 comprises semi-circular end plates 112, 114 which are respectively notched out to fit over the bearing blocks 22 and in the case of end plate 114 to provide a semi-circular opening corresponding to the opening in the end member 24 through which the product such as peas, beans or peanuts are directed by means of a trough 116 supported on a wire bracket 118 whereby the product may be introduced periodically into that end of the drum 18 while it is rotating and without opening the top 110 are removing a segment 120 which is a frame portion of the surface and perhiphery of drum 18 constructed from the long members 44 and a pair of end members 122 which are arcuately shaped to fit into the arcuate portion of the drum between other longitudinal members 44 whereby the entire segment 120 may be removed from small metal clips or brackets 124 which are located on the members 44. Thus, periodically the machine may be stopped and opened and any debris or trash which has been collected inside or has stuck in the wire mesh or to the paddles 40 may be removed and the machine completely cleansed but it is unnecessary of course to do this for the purpose of loading and unloading the machine which is a continuous operation for an indefinite period of time unlike some of the prior art devices which have to be opened for loading and unloading.

Air circulation is provided within the housing 56 and the drum 18 by means of a large air blower 128 which has the delivery opening 130 attached to the end of housing 56 beneath the trough 116 so as continuously to pump air into the partially closed housing 56 and the drum 18 so that air circulates from the input end of the cylinder 18 at trough 116 through the drum towards the output end at the open space 48 and the open end of the end member 26 so as to assist in the circulation and removal of the lighter trash, debris and the hulls from the kernels which tend to drop by gravity through the housing 56. The blower may be of variable speed and controlled to provide selected air flow which also may be controlled by a damper means and adjustable openings whereby the air flow may be adjusted and regulated.

Normally the machine 10 is inclined (from the full lines in FIG. 2 to the dotted lines) by elevating the input end through the adjustment of screw feet 23 in a nut 134 the legs 14. Trial and error will easily determine the degree of inclination depending sometimes on the particular product and the extent of wet and dry mixture. Very dry trash, debris and hulls are readily moved by the air in housing 56 whereas wet hulls and trash are not affected very much by the air but are moved by gravity and the contact by the striking members.

While I have shown and described a particular embodiment of this apparatus and the method of operation thereof this is by way of illustration and does not constitute any limitation on the invention as there are various alternations, changes, amendments, deviations, revisions and departures therefrom so that the scope of my invention is ascertained only by a proper construction of the appended claims.

What is claimed:

1. A method of separating hulls and debris from a plant product selected from the group consisting of peas, beans and peanuts so as to obtain the kernels from said plant product comprising:

inclining a foraminous container which has an input and an output end so that the container is higher on an input end and feeding product into the input end of said container during movement thereof, rotating the product in the container and engaging the product with a plurality of spaced striking members to separate hulls and debris from kernels, delivering the hulls and debris to the output end of the container while the container is rotating, providing a separating means within said container and causing hulls and debris to be separated from the kernels and to move to the output end, dropping the kernels beneath the container, and thereafter collecting some of the hulls and debris through an opening in the container at the output end of the container and collecting the kernels from the bottom of the container after the kernels have dropped from the container during rotation.

2. The method in claim 1 including providing a partly closed housing beneath said container for collecting said kernels and moving air in said housing to move debris from said kernels through an opening in the output end of the housing.

3. The method claimed in claim 1, including: delivering the product into one end of the rotating container during rotation and removing some of the hulls and debris from an opening in the other end of the container during rotation.

4. The method in claim 2 including providing a foraminous shaker means beneath said housing and shaking said kernels to remove debris therefrom.

5. The method in claim 1 including providing an opening in the container adjacent the output end and after the separating means, directing hulls and debris and blowing same from said opening.

6. An apparatus for separating hulls and debris from a plant product selected from the group consisting of peas, beans and peanuts so as to obtain the kernels from said plant product comprising:

a support frame, a foraminous, inclined drum rotatably mounted on said frame for receiving the product to be shelled, said drum having a foraminous, substantially cylindrical cover through which the kernels of the product will pass and an input end and an outlet end, said drum having an outlet opening on one end thereof for hulls and debris and said drum being higher above a support surface on the product input end, for delivering continuously during the rotation of said drum the product to said outlet end having the hull and debris opening therein, separating means within and rotatable with said drum for separating hulls and debris from the kernels, striking means mounted within said drum in spaced relation thereon and comprising a plurality of striking members arranged in longitudinal and radial separation for striking the product introduced into said drum and for delivering same from the entrance end to the other output end of said drum for exit of the hulls and debris through the output end, and drive means for said drum and striking members.

7. The apparatus in claim 6 including a collecting housing on said apparatus located beneath said drum for collecting kernels delivered through said foraminous cover for delivery beneath said drum, said housing having an open top and said drum extending partly therein.

8. The apparatus in claim 6 wherein said separating means comprises a baffle member supported in and spaced from the inside of the drum so that hulls and debris is moved past said baffle but kernels are dropped.

9. The apparatus in claim 8 including means for providing air adjacent the input end of said apparatus and for moving said air through said drum to the outlet end for assisting in the removal of the hulls and debris from the kernels which drop through said housing to the bottom.

10. The device claimed in claim 9 wherein the means for providing air comprises an air blower mounted on said apparatus adjacent an opening leading into the entrance end of said housing beneath said drum.

11. The device claimed in claim 6 wherein there is a shaker means mounted beneath said drum for receiving and shaking the kernels delivered through said housing through a foraminous member, and a drive means for said shaker means.

12. The device claimed in claim 11 wherein said shaker means comprises a drive shaft on said support frame and a shaker eccentric driven by said drive shaft, a shaker frame having a foraminous member thereon through which said kernels pass and in which said kernels are shaken, and said eccentric including a shaker arm connected between said shaker and said shaker frame.

13. The device claimed in claim 6 wherein there is a removable collection container adjacent the exit end of said drum.

14. The device claimed in claim 6 wherein there is a trough means leading to the entrance end of said drum for delivery of the product.

15. The apparatus in claim 6 wherein:

said drum has the hull and debris opening through the foraminous cover at the end opposite from said delivery end for discharging hulls and debris removed and separated within said drum.

16. The device in claim 6 wherein said support frame has substantially vertical legs with adjustable feet thereon for inclining and adjusting the drum to place the input end higher than the output end.

17. The device claimed in claim 6 wherein said drive means comprises a motor means, a drum drive means for driving said drum from said motor means and a striking drive means for driving said striking members, and means for reversing the direction of rotation between said drum and said striker member shaft whereby said drum rotates in a direction opposite from said striking members.

18. The device claimed in claim 17 wherein said drive means comprises:

a motor drive pulley on said motor, a striking members drive shaft extending through said drum and having said striking members thereon, a first drive pulley mounted on said striking members drive shaft, a first drive belt between said motor drive pulley and said first pulley, a second drive pulley on said drum shaft, a second drive shaft on said frame, a third pulley on said second drive shaft and a second drive belt between said second pulley and said third pulley, said second drive belt being turned to reverse direction between said second and third pulleys and the second drive shaft, a fourth pulley on said second drive shaft, a drum pulley on said drum, a drive belt between said fourth pulley and said drum pulley for driving said drum and said striking members in opposite direction of rotation, and means for reversing the direction of rotation between said drum and said striker member shaft whereby said drum rotates in a direction opposite from said striking members.

* * * * *